US007145512B2

(12) United States Patent
Metz

(10) Patent No.: US 7,145,512 B2
(45) Date of Patent: Dec. 5, 2006

(54) RECONFIGURABLE PLASMA ANTENNA WITH INTERCONNECTED GAS ENCLOSURES

(75) Inventor: Carsten Metz, Chatham Township, Morris County, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 11/093,559

(22) Filed: Mar. 30, 2005

(65) Prior Publication Data

US 2006/0220980 A1 Oct. 5, 2006

(51) Int. Cl.
*H01Q 1/26* (2006.01)

(52) U.S. Cl. ..... 343/701; 343/909; 343/700 MS

(58) Field of Classification Search ..... 343/701, 343/909, 700 MS, 753–756
See application file for complete search history.

(56) References Cited

U.S. PATENT DOCUMENTS

| | | | | |
|---|---|---|---|---|
| 5,594,456 | A | 1/1997 | Norris et al. | 343/701 |
| 5,864,322 | A * | 1/1999 | Pollon et al. | 343/909 |
| 6,492,951 | B1 | 12/2002 | Harris et al. | 343/701 |
| 6,512,499 | B1 | 1/2003 | Abe | 345/60 |
| 6,567,046 | B1 | 5/2003 | Taylor et al. | 343/700 MS |
| 6,597,327 | B1 | 7/2003 | Kanamaluru et al. | 343/909 |
| 6,710,746 | B1 * | 3/2004 | Anderson et al. | 343/701 |
| 6,870,517 | B1 * | 3/2005 | Anderson | 343/909 |
| 6,885,345 | B1 * | 4/2005 | Jackson | 343/700 MS |
| 2005/0110691 | A1 * | 5/2005 | Anderson | 343/700 MS |

OTHER PUBLICATIONS

"Gas Plasma," Markland Technologies, http://www.marklandtech.com/gasplasma.html, pp. 1-2, 2003.

* cited by examiner

*Primary Examiner*—Tuyet Vo
*Assistant Examiner*—Ephrem Alemu

(57) ABSTRACT

A reconfigurable antenna comprises an array of interconnected gas enclosures, each of the enclosures being controllable between at least a first state in which gas within the enclosure is substantially non-conducting and a second state in which the gas within the enclosure forms an electrically conductive plasma. At least one pair of adjacent enclosures in the array is arranged such that configuring the pair of enclosures in the second state results in an electrical connection, between a first electrode associated with one of the enclosures of the pair and a second electrode associated with the other enclosure of the pair, through electrically conductive plasma of at least one of the enclosures of the pair. The reconfigurable antenna in an illustrative embodiment is operable in a plurality of different modes of operation by altering, from mode to mode, which of the enclosures are configured in the first state and which of the enclosures are configured in the second state.

20 Claims, 4 Drawing Sheets

RECONFIGURABLE PLASMA ANTENNA WITH INTERCONNECTED GAS ENCLOSURES

FIELD OF THE INVENTION

The present invention relates generally to antennas, and more particularly to antennas which utilize plasma to allow the antenna to be controllable for operation in a variety of different configurations.

BACKGROUND OF THE INVENTION

A variety of plasma antennas are known in the art. One type of plasma antenna, from Markland Technologies Inc. of Fredericksburg, Va., utilizes ionized gas enclosed in a tube or other enclosure as an antenna conducting element. In an arrangement of this type, electrodes are typically located at opposite ends of the hermetically sealed enclosure. Electrical discharge from the electrodes ionizes and excites the gas from a non-conductive gaseous state into an electrically conductive plasma state. The enclosure is formed in a particular fixed shape to provide the desired antenna configuration, such as a parabolic reflector configuration. A drawback of this type of arrangement is that the enclosure shape is fixed and thus cannot be reconfigured into other conductive arrangements. Flexible structures are not practical in such arrangements because they usually cannot be hermetically sealed at reasonable cost, when long lifetimes are desired.

A possible alternative plasma antenna approach is to confine plasma with magnetic fields, which allows the form and density of the plasma to be controlled in wide ranges by varying the magnetic field densities that are generated by electromagnets. However, electromagnets have the disadvantage of being bulky and represent conductive obstacles. They are therefore not suitable for use in antenna applications that depend on free propagation of electromagnetic waves.

It is also known to provide a reconfigurable antenna in which reflective elements are electronically "painted" on a reconfigurable conductive surface using plasma injection of carriers in high-resistivity semiconductors. Such techniques are disclosed in U.S. Pat. No. 6,567,046, issued May 20, 2003 to Taylor et al. and entitled "Reconfigurable Antenna," and U.S. Pat. No. 6,597,327, issued Jul. 22, 2003, to Kanamaluru et al. and entitled "Reconfigurable Adaptive Wideband Antenna." These semiconductor-based arrangements, however, are unduly complex, and require costly components.

Accordingly, a need exists for a reconfigurable plasma antenna which provides a high degree of flexibility in its possible configurations but without the cost and complexity commonly associated with semiconductor-based arrangements.

SUMMARY OF THE INVENTION

The present invention in an illustrative embodiment advantageously provides a reconfigurable plasma antenna which overcomes one or more of the above-noted problems associated with conventional practice.

In accordance with one aspect of the invention, a reconfigurable antenna comprises an array of interconnected gas enclosures, with each of the enclosures being controllable between at least a first state in which gas within the enclosure is substantially non-conducting and a second state in which the gas within the enclosure forms an electrically conductive plasma. At least one pair of adjacent enclosures in the array is arranged such that configuring the pair of enclosures in the second state results in an electrical connection, between a first electrode associated with one of the enclosures of the pair and a second electrode associated with the other enclosure of the pair, through electrically conductive plasma of at least one of the enclosures of the pair.

In the illustrative embodiment, the array of interconnected gas enclosures comprises a substantially planar m×n array of enclosures. The reconfigurable antenna in this embodiment is operable in a plurality of different modes of operation by altering, from mode to mode, which of the enclosures are configured in the first state and which of the enclosures are configured in the second state. A given one of the enclosures is controlled between the first and second states by applying signals to first and second electrodes associated with the given enclosure so as to result in the first and second electrodes being electrically connected through electrically conductive plasma of the given enclosure.

The array of interconnected gas enclosures may comprise, by way of example, an upper layer, a lower layer, and a plurality of sidewalls configured between the upper and lower layers so as to define the enclosures, the enclosures being formed between the upper and lower layers and being separated from one another by one or more of the sidewalls.

In accordance with another aspect of the invention, a common electrode may be shared between a given one of the enclosures and another of the enclosures adjacent to the given enclosure, the common electrode passing through one of the sidewalls which separates the given enclosure from the adjacent enclosure.

In the illustrative embodiment, a given one of the enclosures comprises a walled enclosure having a top, a bottom and four sides, with the four sides of the given enclosure having respective electrodes passing therethrough.

The illustrative embodiment may be configured as a reconfigurable reflector unit by, for example, providing a radio frequency (RF) absorbing substrate adjacent the lower layer of the array. It is also possible to use a backplane arranged adjacent to the lower layer, and separated from the lower layer by a groundplane. The backplane may comprise a substrate having a plurality of control elements formed thereon. Each control element is associated with a corresponding electrode of the array, and supplies a control signal thereto for controlling at least one of the enclosures between the first and the second states. The control elements may comprise conductive vias configured to pass through respective apertures in the groundplane. The backplane may further comprise a plurality of conductive traces coupled to respective ones of the control elements.

Advantageously, the illustrative embodiment provides a reconfigurable arrangement of conductive antenna elements. In this embodiment, arbitrary two-dimensional conductive patterns can be programmed by activating particular ones of the enclosures into their electrically conductive plasma states. Accordingly, a high degree of flexibility is provided but without the cost and complexity commonly associated with semiconductor-based arrangements.

DETAILED DESCRIPTION OF THE INVENTION

The present invention will be illustrated herein in the context of example reconfigurable plasma antenna arrangements. It should be understood, however, that the present invention is not limited to the particular arrangements shown and described. The techniques of the present invention are more generally suitable for use in any antenna application in which antenna operation can be enhanced or facilitated through plasma-based control of antenna conductive elements.

The term "antenna" as used herein is intended to be construed broadly so as to encompass, by way of example and without limitation, any arrangement of conductive elements configured to radiate signals, to receive signals, or both.

Figure 1:
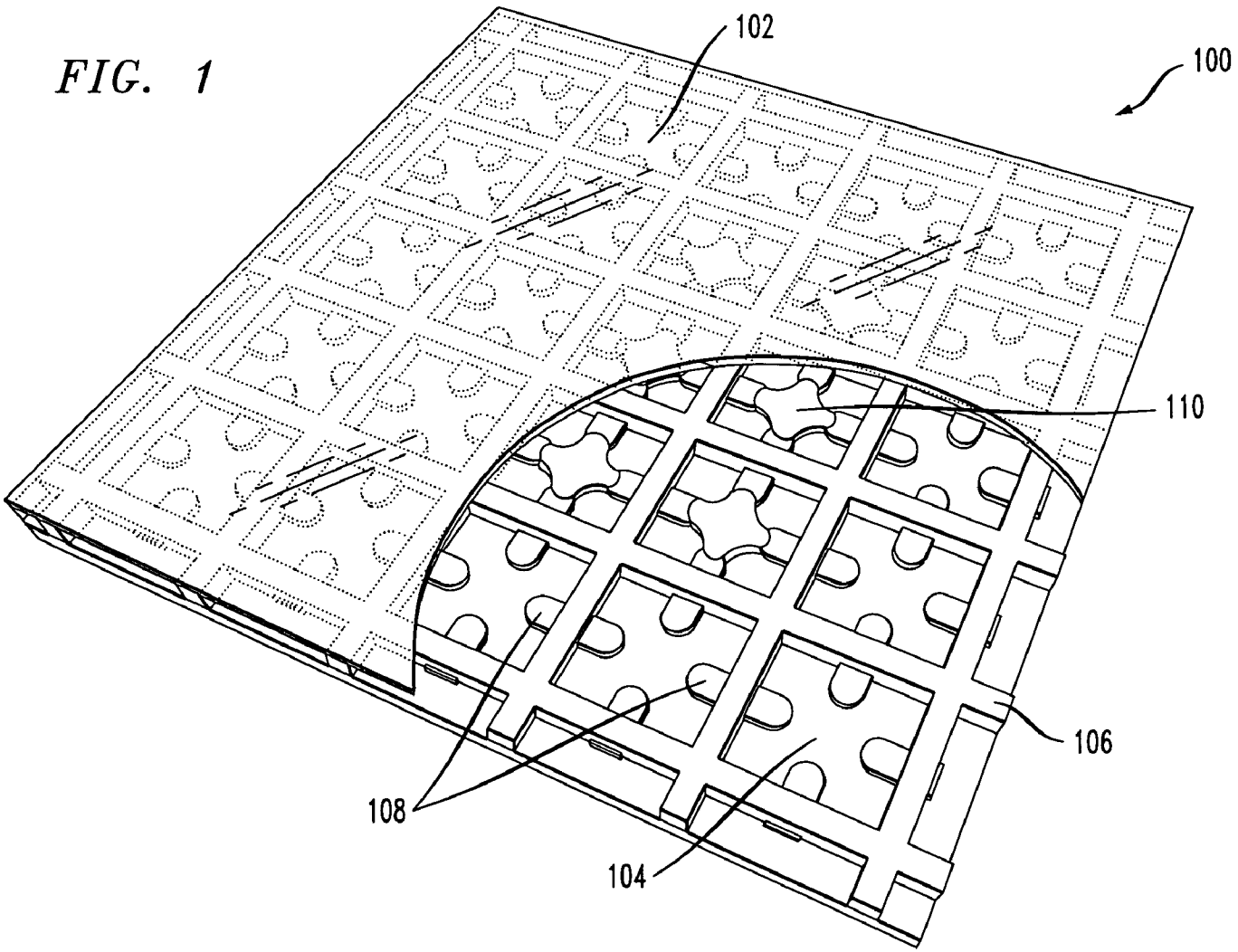
FIG. 1 is a partially cut-away perspective view of a reconfigurable aperture of a reconfigurable plasma antenna in an illustrative embodiment of the invention.

Referring initially to FIG. 1, a portion of a reconfigurable antenna in an illustrative embodiment of the invention is shown. The particular portion of the reconfigurable antenna shown is a reconfigurable aperture 100 which comprises an array of interconnected gas enclosures. The interconnected gas enclosures are formed by an upper layer 102, a lower layer 104, and a plurality of sidewalls 106 configured between the upper and lower layers. The upper and lower layers 102, 104 and sidewalls 106 define the enclosures, with the enclosures being formed between the upper and lower layers and being separated from one another by one or more of the sidewalls. At least one of the upper layer 102, the lower layer 104 and the sidewalls 106 may comprise glass. For example, glass slabs may be used for the upper and lower layers and the sidewalls.

Each of the enclosures contains a small volume of gas that can be ionized and excited into an electrically conductive plasma by one or more applied control signals. Suitable gases that may be used in conjunction with the invention include, by way of example and without limitation, neon, argon, helium, krypton, mercury vapor and xenon.

The array of enclosures in the reconfigurable aperture 100 of FIG. 1 is a substantially planar m×n array of enclosures, although the invention is not restricted to such planar arrangements. As shown, the array comprises a 5×5 array of enclosures, but is to be appreciated that m need not be equal to n, and higher or lower values may be used for m or n, as required to suit the particular needs of a given antenna application. Also, although each enclosure in the FIG. 1 arrangement has substantially the same configuration, alternative embodiments may have enclosures of different size and shape within a given aperture. The term "array" as used herein should be construed generally, and does not require a regularly-spaced arrangement of enclosures such as that of the illustrative embodiment. The particular manner in which the enclosures are interconnected may vary depending upon the needs of a given application. Also, an "array of interconnected gas enclosures" as the phrase is used herein does not require that each of the enclosures be connected or connectable to every other enclosure. Instead, the phrase is intended to be more broadly construed so as to encompass, for example, arrangements in which a given enclosure may be connected or connectable to some but not all of the other enclosures.

The enclosures as shown in FIG. 1 generally comprise walled enclosures, each having a top, a bottom and four sides, with the four sides of the given enclosure having respective electrodes 108 passing therethrough. The electrodes may comprise metal traces or other types of conductors that penetrate these walls. Again, alternative sizes and shapes are possible, such as walled enclosures with more than four sides, or with generally spherical shapes.

As another example, an etched cavity arrangement may be used to form the interconnected gas enclosures. In such an arrangement, the lower layer may comprise a glass slab that is etched on an upper surface thereof to form cavities, and the upper layer may comprise a glass slab which is placed over the etched lower slab, with the covered cavities forming the gas enclosures. Other types of etched arrangements could be used, such as, for example, an arrangement in which a lower surface of the upper layer is etched, or a combination of etched upper and lower layers. One or more intermediate layers may also be used.

Typically, insulating materials capable of being hermetically sealed are preferred in implementing the interconnected gas enclosures.

Each of the enclosures in the FIG. 1 embodiment is controllable between at least a first state in which gas within the enclosure is substantially non-conducting and a second state in which the gas within the enclosure forms an electrically conductive plasma. The control is provided in this embodiment via control signals applied to electrodes 108. Element 110 generally indicates electrically conductive plasma which results when the corresponding enclosure is configured into the second state noted above.

In this arrangement, at least one pair of adjacent enclosures in the array is arranged such that configuring the pair of enclosures in the second state results in an electrical connection, between a first electrode associated with one of the enclosures of the pair and a second electrode associated with the other enclosure of the pair, through electrically conductive plasma of at least one of the enclosures of the pair.

Thus, the reconfigurable antenna may be configured in a plurality of different modes of operation by altering, from mode to mode, which of the enclosures are configured in the first state and which of the enclosures are configured in the second state.

Figure 2:
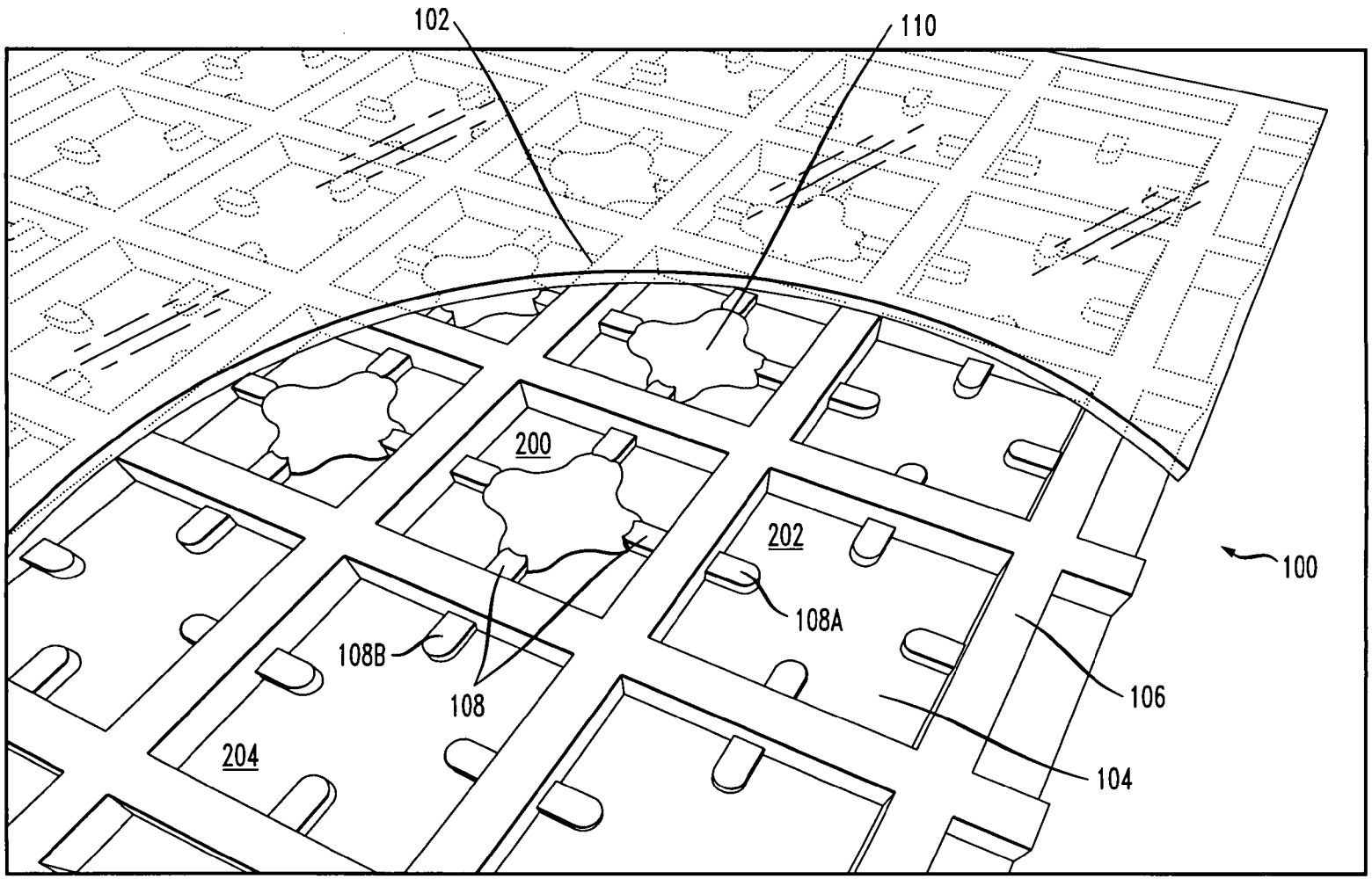
FIG. 2 shows a more detailed view of a portion of the reconfigurable aperture of FIG. 1.

FIG. 2 shows a more detailed view of a portion of the reconfigurable aperture of FIG. 1. It can be more clearly seen that certain of the enclosures are configured in the first state while others are configured in the second state. For example, enclosure 200 is configured in the second state, while enclosure 202 is configured in the first state.

In the illustrative embodiment, the state of a given enclosure is controlled by signals applied to at least first and second electrodes associated with the given enclosure so as to result in the first and second electrodes being electrically connected through the electrically conductive plasma 110 of the given enclosure.

For example, a voltage may be applied between opposing electrodes of the given enclosure in order to transform its insulating gas into an electrically conductive plasma. If an adjacent enclosure is also activated in this manner, it becomes connected to the first one via one of the electrodes, and so on.

Activation of a given enclosure in the illustrative embodiment, in which each of the four sides of the enclosure has a corresponding electrode passing therethrough, results in electrical connection of the four electrodes through the electrically conductive plasma 110.

The particular type of control signals used to activate the gas in the enclosure will vary depending upon application-specific factors such as the type of gas used, its concentration within the enclosure, and the enclosure and electrode configuration. Those skilled in the art will be readily able to determine appropriate control signals for controlling the generation of plasma in a given implementation of the invention.

The electrodes 108 in the illustrative embodiment of FIGS. 1 and 2 include electrodes which are shared between adjacent enclosures. For example, with reference to FIG. 2, a common electrode 108A is shared between a given one of the enclosures, e.g., enclosure 200, and another of the enclosures, e.g., enclosure 202, adjacent to the given enclosure, with the common electrode 108A passing through one of the sidewalls 106 which separates the given enclosure 200 from the adjacent enclosure 202. Similarly, a common electrode 108B is shared between enclosure 200 and another of the enclosures, e.g., enclosure 204, adjacent to the given enclosure, with the common electrode 108B passing through one of the sidewalls 106 which separates the given enclosure 200 from the adjacent enclosure 204. The other electrodes 108 in this embodiment are similarly shared between adjacent enclosures.

Other types of electrode arrangements may be used. For example, in place of a given common electrode, a pair of separate electrodes may be used, with the electrodes of the pair being associated with respective adjacent enclosures, and a conductor or other connection being used to electrically connect the pair of electrodes.

Advantageously, the reconfigurable aperture 100 as shown in FIGS. 1 and 2 provides a reconfigurable arrangement of conductive antenna elements. In this embodiment, arbitrary two-dimensional conductive patterns can be programmed by activating particular ones of the enclosures into their electrically conductive plasma states.

The illustrative embodiment of FIGS. 1 and 2 may be operated as a reconfigurable reflector unit by, for example, placing a radio frequency (RF) absorbing substrate below the lower layer 104.

It is also possible to utilize the illustrative embodiment of FIGS. 1 and 2 with a backplane, as will now be described with reference to FIGS. 3 and 4.

Figure 3:
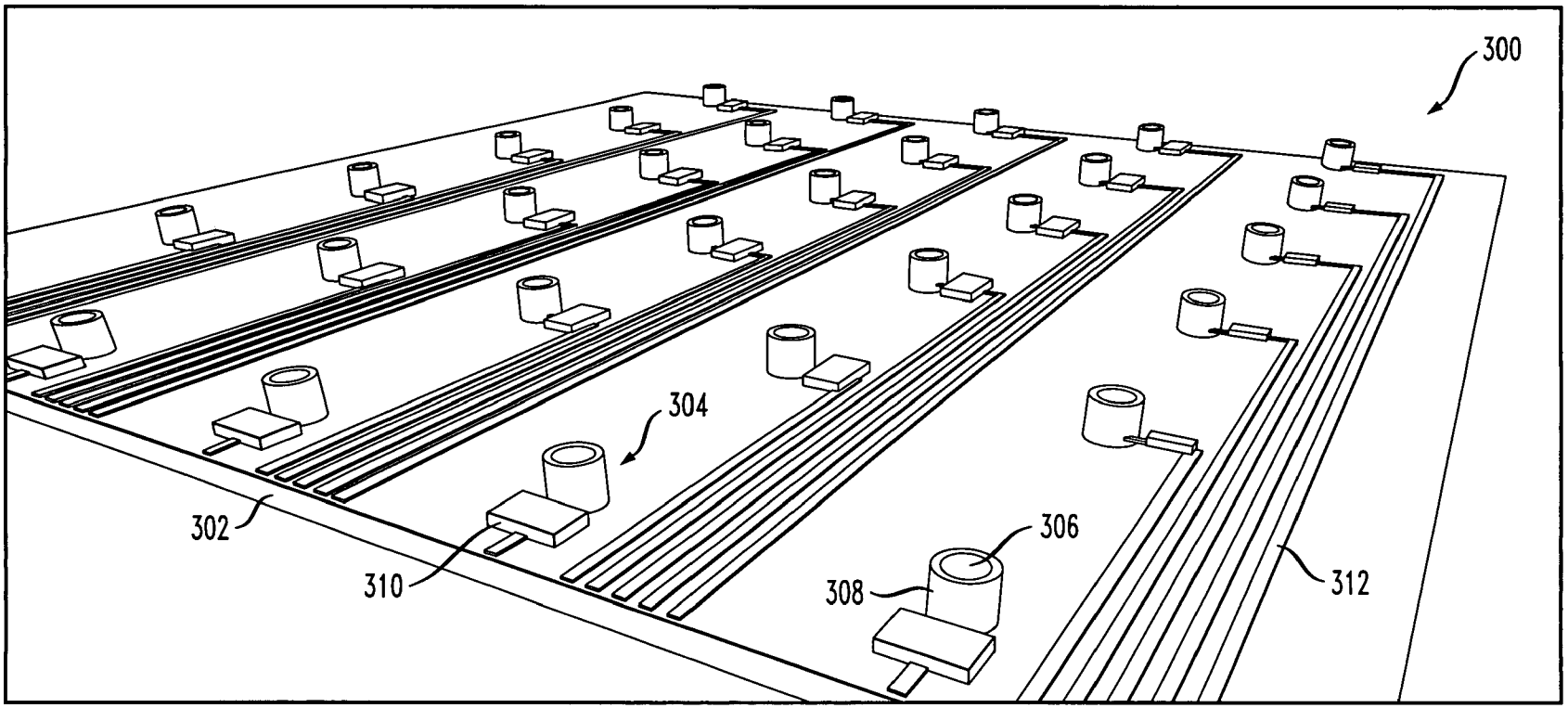
FIG. 3 is a perspective view of a backplane suitable for use with the reconfigurable aperture of FIG. 1.

FIG. 3 shows an embodiment of a backplane 300 suitable for use with the reconfigurable aperture of FIG. 1. The backplane 300 comprises a substrate 302 having a plurality of control elements 304 formed thereon. Each control element is associated with an electrode of the array of interconnected gas enclosures, and supplies a control signal thereto for controlling at least one of the enclosures between the first and the second states.

In this embodiment, the control elements 304 comprise conductive vias 306 configured to pass through respective openings in an overlying groundplane, as will be described in conjunction with FIG. 4. Each of the conductive vias is surrounded by an absorber 308, and has a switch 310 associated therewith. The absorbers 308 serve to reduce field diffractions over the groundplane. The switch 310 may comprise, by way of example, a low pass filter, a direct RF feed, or other type of signal processing element. The switch may be configured so as to ensure that the upper portions of antenna 400 above groundplane 404 can be decoupled from the lower portions below the groundplane, such that RF signals that are within the frequency band of interest remain substantially confined to the upper portions. Alternatively, the switch can bypass the low pass filter to connect its associated vias directly to a feed network, which is not explicitly shown in the figure.

The backplane 300 further comprises a plurality of conductive traces 312 coupled to respective ones of the control elements 304. These conductive traces are used to supply signals from external circuitry, not shown in the figure, to the respective control elements 304.

In one possible implementation, switch 310 comprises a switchable low pass filter that controls whether RF signals are applied to one or more of the vias and thereby to the electrodes of the gas enclosures. More specifically, such an arrangement may be used to provide direct current (DC) from the conductive traces to the enclosure electrodes for the purpose of activating the plasma in selected ones of the enclosures. One or more of the conductive paths that carry the DC voltage to the selected enclosures can also be used to supply RF signals to or receive RF signals from the conductive elements of the antenna. In some arrangements, only a single one of the vias 306 may be needed to supply or receive RF signals, while in other arrangements multiple ones of the vias 306 may be used for this purpose.

The switchable low pass filter in such arrangements may be used to control the flow of RF signals to and from the antenna conductive elements through the vias 306. That is, when the low pass filter is switched into the signal path, the RF signals are blocked, and when the low pass filter is switched out of the signal path, the RF signals can pas through the signal path. However, in both switch positions, the DC voltage is applied to the selected enclosures so as to place each of those enclosures in an electrically conductive plasma state. Numerous alternative switching arrangements can be used for controlling the flow of DC, RF or other signals to and from the gas enclosures, as will be appreciated by those skilled in the art.

As another example, transceiver elements may be incorporated into the control elements 304 of the backplane 300. For example, a transceiver integrated circuit could be included in one or more of the control elements 304.

Figure 4:
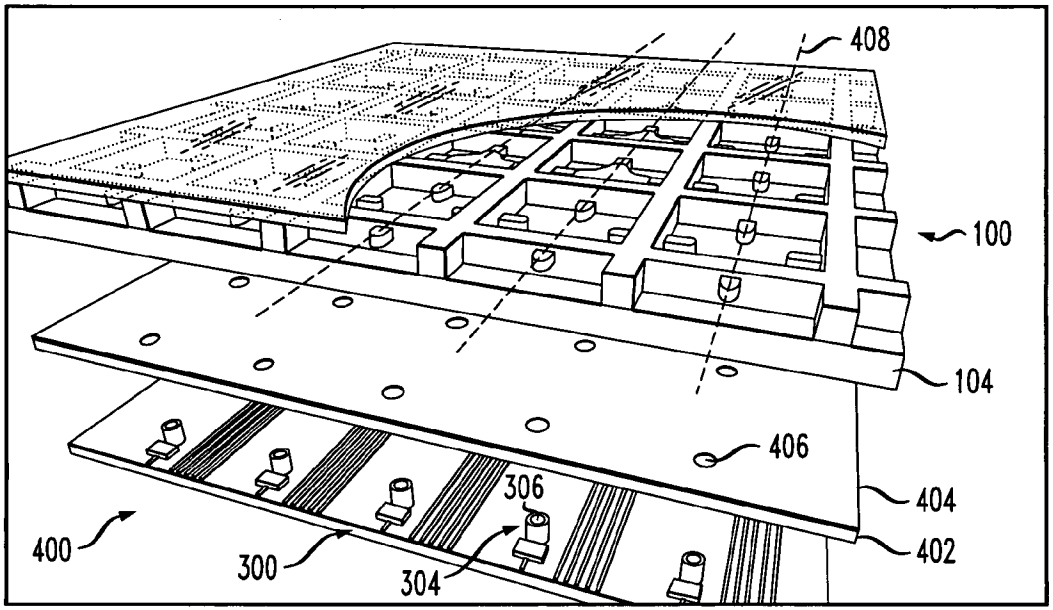
FIG. 4 is an exploded perspective view of a reconfigurable antenna comprising the reconfigurable aperture of FIG. 1 and the backplane of FIG. 3.

FIG. 4 shows a reconfigurable antenna 400 comprising the reconfigurable aperture 100 of FIG. 1 and the backplane 300 of FIG. 3. The backplane 300 is arranged adjacent to the lower layer 104 of the reconfigurable aperture 100, and is separated therefrom by a substrate 402 and a groundplane 404. The substrate 402 and groundplane 404 have openings 406 through which the conductive vias 306 of the backplane pass in order to reach portions of their respective electrodes which extend to a bottom surface of the lower layer 104 of reconfigurable aperture 100. It is to be appreciated, however, that numerous alternative techniques may be used to connect backplane control elements 304 to their respective electrodes in the reconfigurable aperture.

It is apparent from FIG. 4 that the control elements 304 are associated with respective ones of the electrodes 108 that fall along the dashed lines 408. Excitation of the gas in the corresponding enclosures will serve to electrically connect these electrodes as well as the associated electrodes which are perpendicular to the dashed lines 408. Again, this particular interconnection arrangement is presented by way of illustrative example only, and should not be construed as a requirement of the invention.

Reconfigurable aperture 100 of FIGS. 1 and 2 or antenna 400 as shown in FIG. 4 may be combined with additional elements of conventional design, such as feed networks, filters, receivers, transmitters, modulators, demodulators, diplexers, etc. Those skilled in the art will be able to configure a communication device which includes various arrangements of such elements in addition to reconfigurable aperture 100 of antenna 400.

Figure 5:
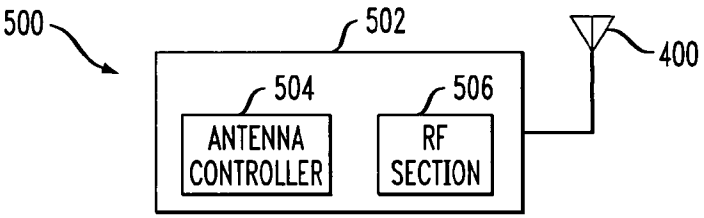
FIG. 5 is a simplified block diagram of a communication device comprising a reconfigurable plasma antenna in an illustrative embodiment of the invention.

FIG. 5 shows one possible implementation of a communication device 500 which includes reconfigurable antenna 400 of FIG. 4. The communication device 500 comprises a transceiver element 502 which may be a transmitter, a receiver, or a combination of a transmitter and a receiver. The antenna 400 is coupled to the transceiver element 502. The transceiver element comprises an antenna controller 504 and an RF section 506. The antenna controller is operative to control the states of the respective enclosures of the antenna 400 to provide a desired antenna configuration, in the manner described previously herein. The RF section 506 is configured for providing RF signals to the antenna, receiving RF signals from the antenna, or both, using well-known techniques. Of course, a reconfigurable plasma antenna in accordance with the present invention is not restricted to use in this particular communication device configuration.

As indicated above, transceiver elements such as transceiver element 502 may be incorporated in whole or in part into one or more of the control elements 304 of the backplane 300. Such a transceiver element may comprise one or more integrated circuits.

The illustrative embodiments described above provide a number of significant advantages over conventional reconfigurable antennas. For example, the reconfigurable plasma antennas of the illustrative embodiments provide a high degree of flexibility in its possible configurations but without the cost and complexity commonly associated with semiconductor-based arrangements. Desired conductor patterns can be programmed into the reconfigurable aperture and immediately deployed to process RF signals. As a more particular example, broadband antennas can be provided, for wireless communications and other applications, which automatically change their configuration to provide optimal performance in the presence of changing network conditions. Thus, it is apparent that the present invention in the illustrative embodiments overcomes the limitations of conventional fixed plasma antennas, but without introducing excessive cost and complexity.

The techniques described herein may be used to implement, by way of example, distributed antennas, antennas comprising planar filters, antennas comprising matching structures, rapid prototyping mechanisms for RF test set-up, and a wide variety of other arrangements involving reconfigurable conductive elements. These and other such arrangements are intended to be encompassed by the general term "reconfigurable antenna" as used herein.

The above-described embodiments of the invention are intended to be illustrative only. As indicated previously, the invention can be implemented at least in part using other antenna types or configurations. Thus, the invention is not restricted in terms of the particular configuration of the antenna in which it is implemented, and a given antenna configured in accordance with the invention may include different arrangements of elements or other elements not explicitly shown or described. These and numerous other alternative embodiments within the scope of the following claims will be readily apparent to those skilled in the art.

What is claimed is:

1. A reconfigurable antenna comprising:

an array of interconnected gas enclosures, each of the enclosures being controllable between at least a first state in which gas within the enclosure is substantially non-conducting and a second state in which the gas within the enclosure forms an electrically conductive plasma;

wherein at least one pair of adjacent enclosures in the array is arranged such that configuring the pair of enclosures in the second state results in an electrical connection, between a first electrode associated with one of the enclosures of the pair and a second electrode associated with the other enclosure of the pair, through electrically conductive plasma of at least one of the enclosures of the pair.

2. The reconfigurable antenna of claim 1 wherein the array of interconnected gas enclosures comprises a substantially planar m×n array of enclosures.

3. The reconfigurable antenna of claim 1 wherein the reconfigurable antenna is operable in a plurality of different modes of operation by altering, from mode to mode, which of the enclosures are configured in the first state and which of the enclosures are configured in the second state.

4. The reconfigurable antenna of claim 1 wherein a given one of the enclosures is controlled between the first and second states by applying signals to first and second electrodes associated with the given enclosure so as to result in the first and second electrodes being electrically connected through electrically conductive plasma of the given enclosure.

5. The reconfigurable antenna of claim 1 wherein the array of interconnected gas enclosures comprises:

an upper layer;

a lower layer; and a plurality of sidewalls configured between the upper and lower layers so as to define the enclosures, the enclosures being formed between the upper and lower layers and being separated from one another by one or more of the sidewalls.

6. The reconfigurable antenna of claim 5 wherein a common electrode is shared between a given one of the enclosures and another of the enclosures adjacent to the given enclosure, the common electrode passing through one of the sidewalls which separates the given enclosure from the adjacent enclosure.

7. The reconfigurable antenna of claim 5 wherein at least one of the upper layer, the lower layer and the sidewalls comprise glass.

8. The reconfigurable antenna of claim 1 wherein a given one of the enclosures comprises a walled enclosure having a top, a bottom and at least four sides.

9. The reconfigurable antenna of claim 8 wherein the four sides of the given enclosure have respective electrodes passing therethrough.

10. The reconfigurable antenna of claim 5 further comprising a radio frequency absorbing substrate adjacent the lower layer.

11. The reconfigurable antenna of claim 5 further comprising a backplane arranged adjacent to the lower layer.

12. The reconfigurable antenna of claim 11 wherein the backplane comprises a substrate having a plurality of control elements formed thereon, each control element being associated with an electrode of the array of interconnected gas enclosures, and supplying a control signal thereto for controlling at least one of the enclosures between the first and the second states.

13. The reconfigurable antenna of claim 12 wherein the backplane is separated from the lower layer by a groundplane.

14. The reconfigurable antenna of claim 13 wherein the control elements comprise conductive vias configured to pass through respective apertures in the groundplane.

15. The reconfigurable antenna of claim 13 wherein the backplane further comprises a plurality of conductive traces coupled to respective ones of the control elements.

16. A communication device comprising:

a transceiver element comprising at least one of a transmitter and a receiver; and a reconfigurable antenna coupled to the transceiver element;

the reconfigurable antenna comprising an array of interconnected gas enclosures, each of the enclosures being controllable between at least a first state in which gas within the enclosure is substantially non-conducting and a second state in which the gas within the enclosure forms an electrically conductive plasma;

wherein at least one pair of adjacent enclosures in the array is arranged such that configuring the pair of enclosures in the second state results in an electrical connection, between a first electrode associated with one of the enclosures of the pair and a second electrode associated with the other enclosure of the pair, through electrically conductive plasma of at least one of the enclosures of the pair.

17. The communication device of claim 16 wherein the transceiver element comprises an antenna controller and a radio frequency section.

18. The communication device of claim 17 wherein the antenna controller is operative to control the states of the respective enclosures of the reconfigurable antenna to provide a desired antenna configuration.

19. The communication device of claim 17 wherein the radio frequency section is configured for at least one of providing radio frequency signals to the reconfigurable antenna and receiving radio frequency signals from the reconfigurable antenna.

20. A method of operating a reconfigurable antenna comprising an array of interconnected gas enclosures, each of the enclosures being controllable between at least a first state in which gas within the enclosure is substantially non-conducting and a second state in which the gas within the enclosure forms an electrically conductive plasma, the method comprising the steps of:

selecting an operating mode for the reconfigurable antenna; and configuring particular ones of the enclosures in the first state and other ones of the enclosures in the second state to support the selected operating mode.

* * * * *